US009860660B1

(12) United States Patent
Bosscher et al.

(10) Patent No.: US 9,860,660 B1
(45) Date of Patent: Jan. 2, 2018

(54) ELECTRONIC DEVICE WITH SPEAKER CAVITY COOLING

(71) Applicant: Apple Inc., Cupertino, CA (US)

(72) Inventors: Nathan P. Bosscher, Campbell, CA (US); Brad G. Boozer, Saratoga, CA (US); Craig M. Stanley, Campbell, CA (US); Jeffrey C. Olson, Saratoga, CA (US); John J. Baker, Cupertino, CA (US); Phillip Michael Hobson, Menlo Park, CA (US); Stephen Brian Lynch, Portola Valley, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 14/720,572

(22) Filed: May 22, 2015

Related U.S. Application Data

(60) Provisional application No. 62/057,867, filed on Sep. 30, 2014.

(51) Int. Cl.
*H04R 29/00* (2006.01)
*H04R 1/00* (2006.01)

(52) U.S. Cl.
CPC ..... *H04R 29/001* (2013.01); *H04R 1/00* (2013.01)

(58) Field of Classification Search
CPC ..... H04R 29/001; H04R 1/00
See application file for complete search history.

(56) References Cited

U.S. PATENT DOCUMENTS

| | | | | |
|---|---|---|---|---|
| 5,357,586 | A * | 10/1994 | Nordschow | H04R 9/022 181/199 |
| 6,549,637 | B1 * | 4/2003 | Risch | H04R 9/022 181/160 |
| 6,956,956 | B2 | 10/2005 | Kuratani et al. | |
| 7,940,951 | B2 | 5/2011 | Chen et al. | |
| 8,259,969 | B2 | 9/2012 | Xi | |
| 8,831,263 | B2 | 9/2014 | Parker et al. | |
| 2008/0075317 | A1 * | 3/2008 | Chen | G06F 1/203 381/397 |
| 2008/0236373 | A1 * | 10/2008 | Motsenbocker | G10H 3/185 84/731 |

FOREIGN PATENT DOCUMENTS

| | | |
|---|---|---|
| GB | 2322500 | 8/1998 |

* cited by examiner

*Primary Examiner* — Simon King
(74) *Attorney, Agent, or Firm* — Kilpatrick Townsend & Stockton LLP

(57) ABSTRACT

An electronic device may have a housing. The housing may enclose an interior cavity. A speaker may be mounted in an opening in the housing. The interior cavity may serve as a sealed back volume for the speaker during normal operation of the speaker. During normal operation, control circuitry in the interior cavity plays audio content through the speaker. When it is desired to cool the control circuitry and the speaker, the control circuitry supplies a subaudible signal to the speaker. Airflow regulators having one-way valves and valves that are controlled by the control circuitry are mounted in the housing. Movement of a diaphragm in the speaker when the subaudible speaker is applied causes the diaphragm to pump air through the airflow regulators, creating a cooling airflow through the interior cavity.

20 Claims, 4 Drawing Sheets

ELECTRONIC DEVICE WITH SPEAKER CAVITY COOLING

This application claims the benefit of provisional patent application No. 62/057,867, filed Sep. 30, 2014, which is hereby incorporated by reference herein in its entirety.

BACKGROUND

This relates generally to electronic devices, and, more particularly, to cooling electrical components in electronic devices with speakers.

Electronic devices include electrical components such as integrated circuits, and other circuitry. This circuitry may be used in forming communications circuits, control circuits, power supplies, and other circuits within an electronic device. During operation, the circuitry of an electronic device produces heat. Excess heat can damage device components, so the heat that is produced by the circuitry should be removed from the device.

It can be challenging to design a cooling system for an electronic device. Some cooling systems produce undesirable levels of noise. Noise can interfere with the use of the electronic device. Other cooling systems may produce insufficient amounts of cooling. When a device is cooled insufficiently, there is a risk that parts may overheat and cause damage. The challenges associated with cooling an electronic device can be exacerbated when the electrical components to be cooled are mounted within a sealed cavity or a poorly ventilated cavity.

It would therefore be desirable to be able to provide improved cooling techniques for electronic devices that include heat producing components.

SUMMARY

An electronic device may have a housing. The housing may enclose an interior cavity. Electrical components and other circuitry may be mounted within the interior cavity. The electrical components may form control circuitry for the electronic device.

A speaker may be mounted in an opening in the housing. The interior cavity may serve as a sealed back volume for the speaker during normal operation of the speaker. During normal operation, the control circuitry in the interior cavity plays audio content through the speaker. When it is desired to cool the control circuitry and the speaker, the control circuitry supplies a subaudible signal to the speaker. Airflow regulators having one-way valves and valves that are controlled by the control circuitry are mounted in openings in the housing. Movement of a diaphragm in the speaker when the subaudible speaker is applied and when the control circuitry opens the valves in the airflow regulators causes the diaphragm to pump air through the air regulators, creating a cooling airflow through the interior cavity.

DETAILED DESCRIPTION

An electronic device may have electrical components that produce heat during operation. The electronic device may have a cooling system that uses one or more speakers to move air and thereby help cool the components. Airflow values may be used to control the flow of cooling air. Speakers can move air during a pumping mode in which the speakers are driven using subaudible frequencies.

Cooling operations can be controlled using control circuitry in the electronic device. The control circuitry may monitor sensors and other circuitry to determine whether active cooling criteria have been satisfied. When appropriate criteria are satisfied, the control circuitry may place airflow valves within the device into a state that allows speaker motions in the device to cool the heat-producing components.

Figure 1:
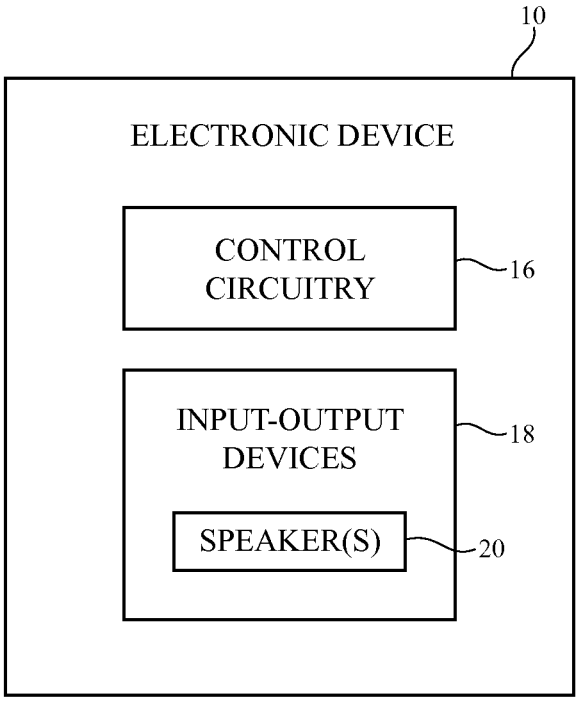
FIG. 1 is a schematic diagram of an illustrative electronic device in accordance with an embodiment.

An illustrative electronic device of the type that may be provided with speaker-based cooling capabilities is shown in FIG. 1. Electronic device 10 may be a computing device such as a computer, a display (e.g., a computer monitor, television, or other display), audio equipment (e.g., a standalone speaker, a speaker that has electronics for performing communications functions and other functions in addition to playing audio content, a speaker that is integrated into an entertainment system, a speaker that is embedded within an automobile, kiosk, gaming device, or other embedded system enclosure, a speaker that is mounted into furniture or a wall in a home, office, or other building, a speaker in a radio, a portable speaker that uses battery power, a subwoofer, a satellite speaker, other electronic equipment that plays audio for a user, equipment that implements the functionality of two or more of these devices, or other electronic equipment).

As shown in FIG. 1, electronic device 10 may have control circuitry 16. Control circuitry 16 may include storage and processing circuitry for supporting the operation of device 10. The storage and processing circuitry may include storage such as hard disk drive storage, nonvolatile memory (e.g., flash memory or other electrically-programmable-read-only memory configured to form a solid state drive), volatile memory (e.g., static or dynamic random-access-memory), etc. Processing circuitry in control circuitry 16 may be used to control the operation of device 10. The processing circuitry may be based on one or more microprocessors, microcontrollers, digital signal processors, baseband processors and other wireless communications circuits, power management units, audio chips, application specific integrated circuits, etc.

Input-output circuitry in device 10 such as input-output devices 18 may be used to allow data to be supplied to device 10 and to allow data to be provided from device 10 to external devices. Input-output devices 18 may include buttons, joysticks, scrolling wheels, touch pads, key pads, keyboards, microphones, one or more speakers 20, tone generators, vibrators, cameras, sensors such as touch sensors, proximity sensors, ambient light sensors, compasses, pressure sensors, temperatures sensors, force sensors, gyroscopes, accelerometers, light-emitting diodes and other status indicators, data ports, etc. A user can control the operation of device 10 by supplying commands through input-output devices 18 and may receive status information and other output from device 10 using the output resources of input-output devices 18.

Input-output devices 18 may include one or more displays. Device 10 may, for example, include a touch screen display that includes a touch sensor for gathering touch input from a user or a display that is insensitive to touch. A touch sensor for a display in device 10 may be based on an array of capacitive touch sensor electrodes, acoustic touch sensor structures, resistive touch components, force-based touch sensor structures, a light-based touch sensor, or other suitable touch sensor arrangements.

Power for device 10 may be provided by an external source of power and/or an internal battery. The components for device 10 such as circuitry 16 and devices 18 and other structures in device 10 may be implemented using integrated circuits, discrete components (e.g., resistors, capacitors, and inductors), microelectromechanical systems (MEMS) devices, portions of housing structures, packaged parts, and other devices and structures.

Control circuitry 16 may be used to run software on device 10. During operation of device 10, the software running on control circuitry 16 may gather input from a user or an external source, may gather input from internal components such as sensors, may process internally obtained information and/or externally obtained information, may control components within device 10, and may provide output using speakers, light-emitting components, and other output components. Device 10 may use communications circuits to send and receive wireless and wired data. For example, device 10 may use wireless circuits in circuitry 16 (e.g., a baseband processor and associated radio-frequency transceiver circuitry) to transmit and receive wireless signals such as cellular telephone signals and/or wireless local area network signals or other wireless data.

Figure 2:
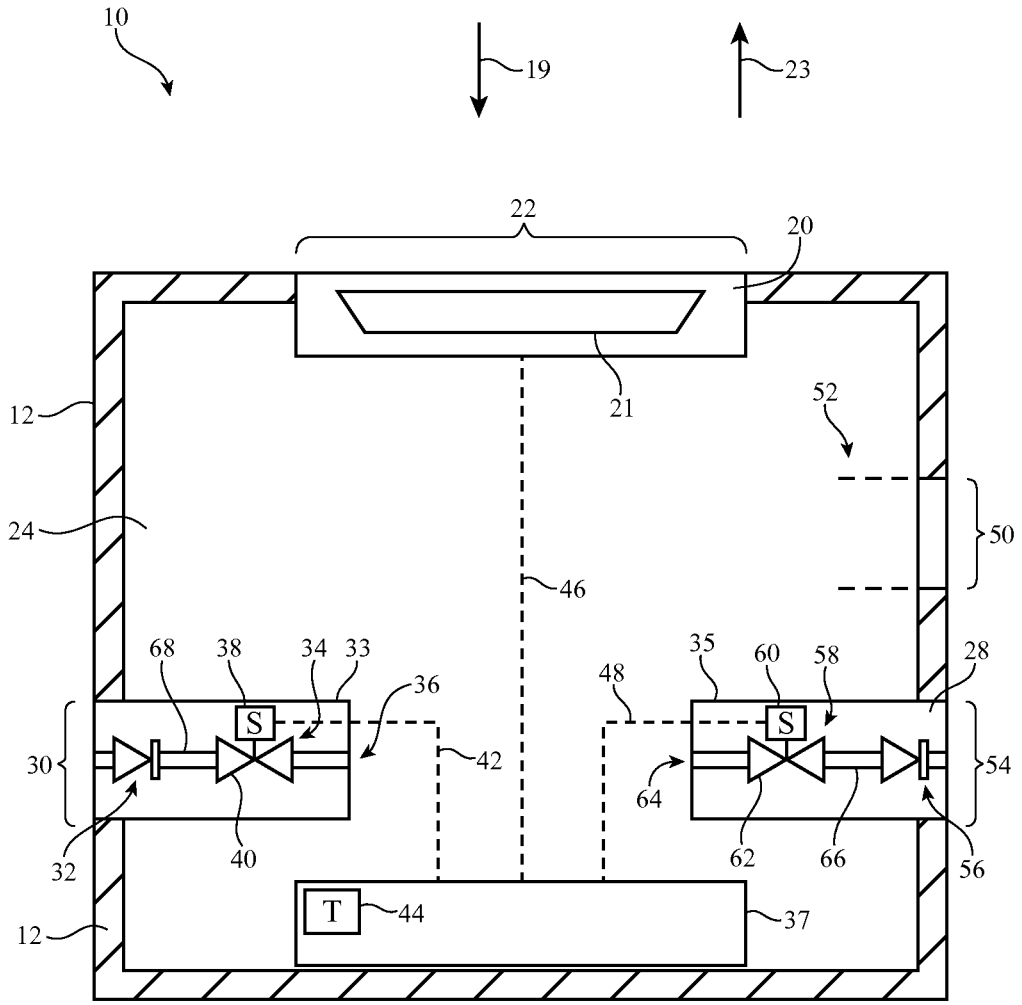
FIG. 2 is a cross-sectional side view of an illustrative electronic device in accordance with an embodiment.

A cross-sectional side view of an illustrative electronic device is shown in FIG. 2. As shown in FIG. 2, device 10 may have a housing such as housing 12. Housing 12, which may sometimes be referred to as an enclosure or case, may be formed of plastic, glass, ceramics, fiber composites, metal (e.g., stainless steel, aluminum, etc.), other suitable materials, or a combination of any two or more of these materials. Housing 12 may be formed using a unibody configuration in which some or all of housing 12 is machined or molded as a single structure or may be formed using multiple structures (e.g., an internal frame structure, one or more structures that form exterior housing surfaces, etc.). Device 10 may have inner housing structures that provide additional structural support to device 10 and/or that serve as mounting platforms for printed circuits and other structures. Structural internal housing members may sometimes be referred to as housing structures and may be considered to form part of housing 12.

Housing 12 may have an interior space such as cavity 24. Cavity 24 may serve as the back volume for one or more speakers such as speaker 20. Speaker 20 may be mounted in an opening in housing 12 such as opening 22. Speaker 20 may be used to play audio for a user of device 10 and may be a tweeter, midrange driver, woofer, or subwoofer (as examples).

Cavity 24 may be a sealed cavity or a ported cavity. In a sealed cavity configuration, cavity 24 is normally enclosed and free of any ports to the exterior of device 10. In a ported cavity configuration, housing 12 may be provided with one or more speaker ports such as port 52 that are vented to the exterior of device 10 using openings in housing 12 such as opening 50. In ported cavity configurations, internal baffles or other structures may optionally be included in cavity 24 to help direct airflow. Configurations for device 10 that use a sealed cavity that forms a back volume for speaker 20 are sometimes described herein as an example. This is, however, merely illustrative. Device 10 may, in general, use any suitable type of speaker cavity.

As shown in FIG. 2, housing 12 may have openings such as openings 30 and 54 to accommodate airflow regulators 33 and 35. Airflow regulators 33 and 35 may be used in conjunction with one or more speakers such as speaker 20 to pump air through cavity 24 of device 10 when it is desired to cool heat-producing components 37 in cavity 24. Components 37 may include control circuitry 16 and input-output devices 18 of FIG. 1 (e.g., integrated circuits, power supply components, audio amplifiers for supplying drive signals to the audio drivers in speakers such as speaker 20, and/or other components). Components 37 can produce heat during operation. The driver for speaker 20, which may also be exposed to cavity 24 can also produce heat during operation. To ensure that components such as these that produce heat within cavity 24 are properly cooled, device 10 can use the air pumping capabilities of speaker 20 and airflow regulators 33 and 35 to cause cooling air to flow through cavity 24. The control circuitry of device 10 may use temperature sensors such as temperature sensor 44 to make real time temperature measurements of temperatures within device 10 such as the temperature of cavity 24. The control circuitry can control the operation of airflow regulators 33 and 35 based on temperature measurements from temperature sensor 44 and/or based on other information.

Airflow regulators 33 and 35 may include passive airflow valves and/or actively controlled airflow valves. As shown in FIG. 2, for example, airflow regulator 33 may have a passive one-way airflow valve such as one-way valve 32 and may have an actively controlled airflow valve such as valve 34. Valve 34 may have an actuator such as actuator 38 that opens and closes a two-way controllable valve such as airflow valve 40. Air passageway 68 couples one-way valve 32 and controllable valve 34. One-way valve 32 and controllable valve 34 are coupled in series between opening 30 in housing 12 and opening (port 36). Opening 30 is vented to the outside of device 10 through housing 12 to allow air to be drawn into one-way valve from the exterior of device. Opening 36 is vented to cavity 24 in the interior of device 10 to allow air to exit controllable valve 34 into cavity 24.

In airflow regulator 35, actively controlled airflow valve 58 has an actuator such as actuator 60 that opens and closes a two-way controllable valve such as airflow valve 62. Air passageway 66 couples passive one-way valve 56 and controllable valve 58. One-way valve 56 and controllable valve 58 are coupled in series between opening (port 64) in cavity 24 and exterior opening 54 in housing 12. Opening 64 is open to cavity 24 in the interior of device 10 to allow air to exit cavity 24 and enter controllable valve 58. Opening 54 is vented to the outside of device 10 through housing 12 to allow air to pass through one-way valve 56 to the exterior of device 10.

Actuators 38 and 60 may be solenoids or other electromechanical devices for opening and closing valves 40 and 62, respectively and thereby placing valves 40 and 62 (and therefore airflow regulators 33 and 35) in open or closed states. Signal path 42 may be used to allow control circuitry in circuitry 37 to supply control signals to actuator 38 in controllable valve 34 (i.e., to open or close valve 34 and regulator 33). Signal path 448 may be used to allow control circuitry in circuitry 37 to supply control signals to actuator 60 in controllable valve 58 (i.e., to open or close valve 58 and regulator 35). Signal path 46 may couple control circuitry in circuitry 37 to speakers such as speaker 20.

During normal operation, control circuitry in circuitry 37 (control circuitry 16) may supply audio signals to speaker 20 to play audio content for a user. For optimum performance, airflow regulators 33 and 35 are placed in their closed states, thereby ensuring that cavity 24 is well sealed and isolated from the exterior of device 10. The sealed back volume created by closing the airflow regulators allows speaker 20 to efficiently produce sound on the exterior of device 10 without interference from sound inside device 10. When appropriate, control circuitry 16 may use regulators 33 and 35 to pump air through cavity 24 by opening airflow regulators 33 and 35. In open-valve mode, cool air flows into cavity 24 from port 30 through one-way valve 32, passageway 68, and open valve 34 of regulator 33 and hot air flows out of cavity 24 to the exterior of device 10 through open valve 60, passageway 66, and one-way valve 56.

Air is pumped through device 10 during cooling by movements of diaphragm 21 of speaker 20. When diaphragm 21 moves outwards from cavity 24 in direction 23, air is drawn into cavity 24 through one-way valve 32 while one-way valve 56 is closed due to back pressure. When diaphragm 21 moves inwards towards cavity 24 in direction 19, hot air in cavity 24 (i.e., the air that has been heated by heat-producing components 37 and/or speaker 20) is expelled from cavity 24 to the exterior of device 10 through one-way valve 56 while one-way valve 32 is closed due to back pressure.

Air pumping to cool device 10 may be performed during normal operation (at some loss of audio playback efficiency because the opening of cavity 24 to the air around device 10 will create a leak in back volume 24 for speaker 20) or may be restricted to times at which no audio is being played through speaker 20. In a networked environment or in a device with multiple speakers in isolated cavities, audio content may be momentarily handled by another speaker in the network or by a speaker in a different cavity within device 10 to allow audio playback to speaker 20 to be suspended while air pumping is used to cool cavity 24.

The frequency at which speaker 21 is driven during cooling is preferably subaudible (e.g., inaudible or nearly inaudible). Frequencies below 20 Hz are typically inaudible to a user and may therefore be used without creating audible disturbances in the user's listening environment. Low volume drive signals at higher frequencies may also be used (particularly in configurations in which the audio efficiency of device 10 at these higher frequencies is relatively low). In general, any suitable signal may be applied to speaker 20 using control circuitry 16 to create movement of diaphragm 21 and thereby create an air pumping action in device 10. The use of subaudible frequencies (e.g., 20 Hz or lower, 15 Hz or lower, 10 Hz or lower, 5 Hz or lower, etc.) is illustrative.

Figure 3:
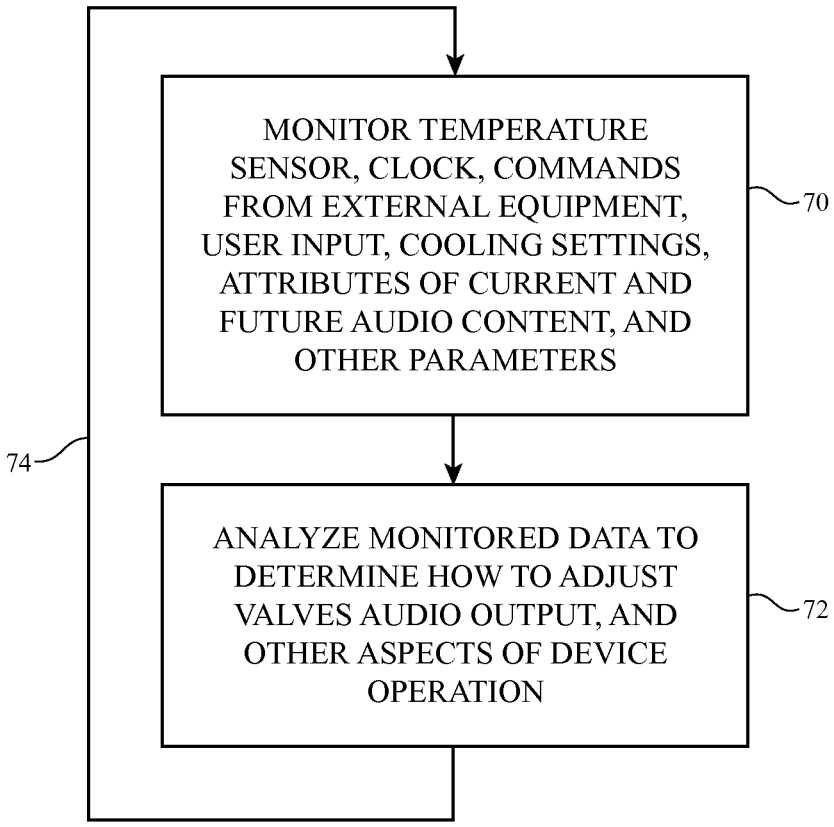
FIG. 3 is a flow chart of illustrative operations involved in monitoring an electronic device to determine when active cooling steps should be taken to cool heat-producing components in the device in accordance with an embodiment.

Control circuitry 16 may gather data from sensors and other sources during operation. Control circuitry 16 may then open and close airflow regulators 33 and 35 based on this information. Illustrative steps involved in determining how to control airflow regulators 33 and 35 during operation of device 10 are shown in FIG. 3. At step 70, control circuitry 16 may gather data from one or more sources. As an example, control circuitry 16 may gather information from one or more sensors in device 10. Control circuitry 16 may make temperature measurements using one or more temperature sensors such as temperature sensor 44. Control circuitry 16 may also consult an internal clock in circuitry 16 to determine the current time. Commands from external equipment (e.g., a network controller such as a computer or other host, a remote control, a source of streaming audio, or other equipment) may be received using wired or wireless communications circuitry. User commands from input-output devices such as a button or touch screen on device 10 may also be received. Cooling settings and other settings may be maintained in memory in device 10 and may, during the operations of step 70, be retrieved for processing by control circuitry 16. Control circuitry 16 may also gather information on current and future audio content that is being (or will be) played back to the user with speaker 20. For example, control circuitry 16 can examine the content of an audio buffer that is being used to buffer content before playing the content through speaker 20. Other information may also be gathered (e.g., using any of the sensors or other components in input-output devices 18 or other devices).

At step 72, control circuitry 16 may analyze the information gathered during the operation of step 70 to determine whether predetermined criteria for adjusting air pumping operations have been satisfied. For example, measured temperature data may be compared to predetermined temperature threshold values, information on the current time from a clock can be compared to a predetermined schedule, commands from external equipment or a button press or other local input device may be processed to determine whether action should be taken in response to receipt of the commands or other input, cooling settings (e.g., thresholds, schedules, actions to take based on certain commands, etc.) can also be used in processing the data at step 72. If desired, audio content in a memory buffer or other location may be analyzed. Audio content analysis can identify current and future heat producing activities (e.g., the playing back of audio content with heavy bass content) for which action may be taken using the air pumping cooling scheme enabled by airflow regulators 33 and 35. As an example, if future heat production is predicted, it may be appropriate to pre-cool cavity 24 in anticipation of upcoming heat. Audio content analysis can also identify quiet or audio-free periods during which speaker 20 is available for producing cooling. Device 10 can be cooled whenever normal audio is absent.

As indicated by line 74, control circuitry 16 may continually gather information during step 70 and analyze that information during step 72 to determine whether airflow regulators 33 and 35 and speaker drive signals for speaker 20 should be adjusted to reduce or increase air pumped airflow through cavity 24.

Figure 4:
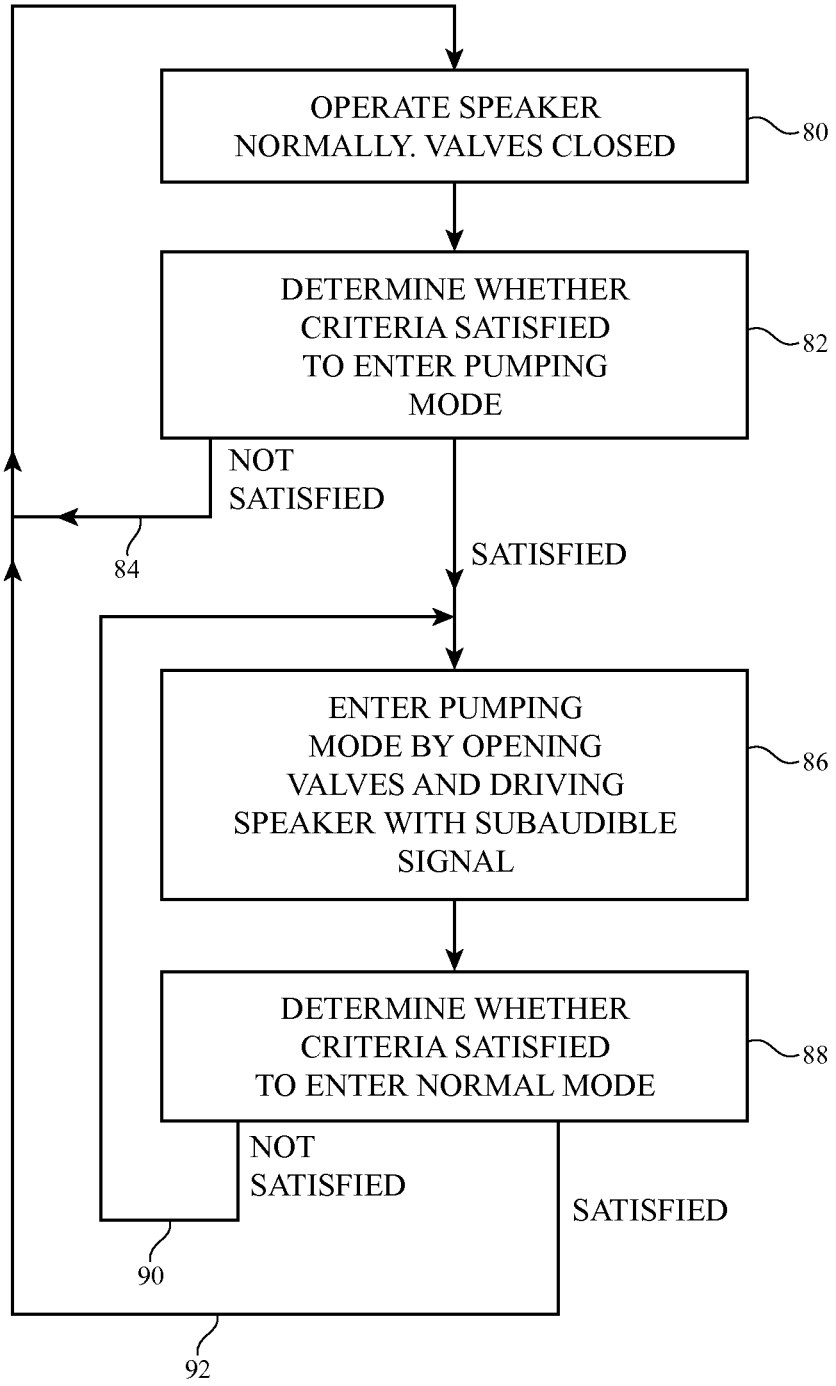
FIG. 4 is a flow chart of illustrative steps involved operating an electronic device with a speaker in accordance with an embodiment.

Illustrative steps involved in operating device 10 are shown in FIG. 4. At step 80, control circuitry 16 may operate device 10 normally. During normal operation, audio content may be played through speaker 20. Control circuitry 16 may supply audio content drive signals to speaker 20 using path 46. Back volume 24 may be sealed during normal audio playback by closing airflow regulators 33 and 35 (i.e., by closing valves 34 and 58) using control signals supplied by control circuitry 16 over paths 42 and 48. The sealed back volume produced by closing regulators 33 and 35 will help ensure that speaker 20 performs optimally.

At step 82, control circuitry 16 may perform operations of the type described in connection with steps 70 and 72 of FIG. 3 to determine whether suitable criteria have been satisfied indicating that device 10 should be placed in an air pumping mode to cool speaker 20 and components 37 in cavity 24. For example, control circuitry 16 can determine whether a measured temperature from sensor 44 has exceeded a predetermined maximum temperature threshold. Control circuitry 16 may also determine whether a scheduled cooling time has arrived or whether a "cool" command has been received from external equipment or local user input. Control circuitry 16 can determine whether audio content is absent so that no audio content will be disrupted by entering cooling mode, can determine whether upcoming audio is predicted to be producing heat in the future for which advanced cooling operations would be advisable, or can make other comparisons between information gathered from sensors and other sources to determine whether air pumping cooling operations should be initiated.

If, during the operations of step 82, it is determined that the criteria for initiating air pumping have not been satisfied, processing may loop back to step 80 for more normal mode operations, as indicated by line 84. If, however, the operations of step 82 reveal that the criteria for initiating air pumping have been satisfied, control circuitry 16 may initiate air pumping operations at step 86. In particular, control circuitry 16 may enter air pumping mode by opening airflow regulators 33 and 35 and driving speaker 20 with a subaudible signal to move diaphragm 21 up and down. As described in connection with FIG. 2, the movement of diaphragm 21 will cause cool air to be drawn into cavity 24 through opening 30 and will cause hot air to be expelled from cavity 24 through opening 54, thereby cooling the interior of housing 12.

At step 88, control circuitry 16 may perform operations of the type described in connection with steps 70 and 72 of FIG. 3 to determine whether suitable criteria have been satisfied indicating that device 10 should be taken out of the air pumping mode and returned to the normal operating mode. For example, control circuitry 16 can determine whether temperatures have dropped to acceptable levels, a cooling schedule has expired, commands have been received from external equipment or local user input indicating that normal operation should be started and cooling ceased, audio playback operations that were previously absent or suspended are about to be resumed or have resumed, or other criteria have been satisfied indicating that device 10 should return to normal operation. If the criteria are not satisfied, processing may loop back to step 86 and device 10 will remain in air pumping (cooling) mode, as indicated by line 90. If the criteria are satisfied, processing may loop back to step 80 (i.e., normal operation may be resumed by closing airflow regulators 33 and 35, removing the subaudible signal from speaker 20, and playing normal audio content for a user through speaker 20 with control circuitry 16).

The foregoing is merely illustrative and various modifications can be made by those skilled in the art without departing from the scope and spirit of the described embodiments. The foregoing embodiments may be implemented individually or in any combination.

What is claimed is:

1. An electronic device, comprising;
a housing having an interior cavity;
a speaker having a diaphragm;
an airflow regulator; and
an actuator configured to move the airflow regulator between an open state and a closed state in accordance with a temperature of the interior cavity,
wherein movement of the diaphragm creates airflow through the airflow regulator that cools the interior cavity when the airflow regulator is in the open state.

2. The electronic device defined in claim 1 wherein the airflow regulator is a first airflow regulator and the electronic device further comprises a second airflow regulators, the first and second airflow regulators being position in respective first and second openings in the housing.

3. The electronic device defined in claim 1 wherein in the closed state the airflow regulator prevents airflow from passing through the interior cavity.

4. The electronic device defined in claim 2 wherein the first airflow regulator includes a first one-way valve and a first controllable valve coupled in series between the first opening and the interior cavity.

5. The electronic device defined in claim 4 wherein the second airflow regulator includes a second controllable valve and a second one-way valve coupled in series between the interior cavity and the second opening.

6. The electronic device defined in claim 1 further comprising control circuitry in the interior cavity that is cooled by the airflow.

7. The electronic device defined in claim 6 wherein the airflow regulator comprises first and second controllable valves and wherein the control circuitry sends a control signal directing the actuator to open the first and second controllable valves during air pumping operations in which motion of the diaphragm creates the airflow.

8. The electronic device defined in claim 7 wherein the control circuitry supplies a subaudible drive signal to the speaker during the air pumping operations.

9. The electronic device defined in claim 8 wherein the control circuitry closes the first and second controllable valves during normal audio playback operations in which audio content for a user is played through the speaker.

10. The electronic device defined in claim 9 further comprising a temperature sensor in the interior cavity, wherein the control circuitry opens and closes the first and second controllable valves based at least partly on temperature data from the temperature sensor.

11. The electronic device defined in claim 9 wherein the control circuitry analyzes audio content and wherein the control circuitry opens and closes the first and second controllable valves based at least partly based on analysis of the audio content.

12. The electronic device defined in claim 9 wherein the speaker comprises a subwoofer.

13. The electronic device defined in claim 12 wherein the subaudible signal has a frequency of less than 20 Hz.

14. An electronic device, comprising;
a housing having an interior cavity;
a speaker having a diaphragm;
an airflow regulator having an open state and a closed state;
a speaker having a diaphragm configured to create a flow of air through the interior cavity when the airflow regulator is in the open state; and
an actuator configured to control the state of the airflow regulator move the airflow regulator between the open state and the closed state.

15. The electronic device defined in claim 14 wherein the interior cavity forms a sealed back volume for the speaker while the speaker plays audio content and wherein the speaker pumps air into the interior cavity through the airflow regulator during an air pumping mode of operation.

16. The electronic device defined in claim 15, further comprising control circuitry disposed within the interior cavity and configured to send control signals to the actuator, wherein the control circuitry in the interior cavity is cooled when the speaker pumps the air.

17. The electronic device defined in claim 16, wherein the airflow regulator comprises
a first controllable valve; and
a second controllable valve coupled to the second one-way valve,
wherein when the airflow regulator is in the open state the control circuitry opens the first and second controllable valves to place the device in the air pumping mode of operation while the subaudible signal is being used to drive the speaker.

18. An apparatus, comprising:

a housing having an interior cavity;

a first opening in the housing;

a controllable valve positioned between the first opening and the interior cavity;

an actuator configured to move the controllable valve between an open state and a closed state in accordance with a temperature detected by the apparatus; and a speaker in a second opening in the housing, wherein the speaker has a diaphragm.

19. The apparatus defined in claim 18 wherein the airflow exits the interior cavity through the controllable valve, and wherein the drive signal comprises a subaudible signal that is supplied while no audible signals are being played by the speaker.

20. The apparatus defined in claim 18, further comprising:

control circuitry that sends a control signal to the actuator in accordance with a temperature of the interior cavity while applying a drive signal to the speaker to move the diaphragm and create cooling airflow through the interior cavity.

* * * * *